US007644711B2

(12) United States Patent
Creel

(10) Patent No.: US 7,644,711 B2
(45) Date of Patent: Jan. 12, 2010

(54) SPARK ARRESTOR AND AIRFLOW CONTROL ASSEMBLY FOR A PORTABLE COOKING OR HEATING DEVICE

(75) Inventor: John Creel, Kennesaw, GA (US)

(73) Assignee: The Big Green Egg, Inc., Tucker, GA (US)

( * ) Notice: Subject to any disclaimer, the term of this patent is extended or adjusted under 35 U.S.C. 154(b) by 131 days.

(21) Appl. No.: 11/462,381

(22) Filed: Aug. 4, 2006

(65) Prior Publication Data

US 2007/0047166 A1 Mar. 1, 2007

Related U.S. Application Data

(60) Provisional application No. 60/705,912, filed on Aug. 5, 2005.

(51) Int. Cl.
*F24C 1/14* (2006.01)

(52) U.S. Cl. ..... 126/80; 126/21 R; 126/293; 126/25 R; 126/84

(58) Field of Classification Search ..... 126/25 R, 126/21 R, 279, 293, 80, 84; 110/119, 123, 110/124, 125; 454/29, 64, 274, 298, 324, 454/334, 358

See application file for complete search history.

(56) References Cited

U.S. PATENT DOCUMENTS 1,537,216 A 5/1925 Bagby
1,641,022 A 8/1927 Calhoun
1,740,486 A * 12/1929 Wheelock ..... 126/551
2,722,883 A 11/1955 Rignell
2,776,707 A * 1/1957 Helwig ..... 160/118
2,820,513 A * 1/1958 Drakoff ..... 55/422
3,027,887 A * 4/1962 Krohncke ..... 126/25 R
3,118,749 A * 1/1964 Acacia ..... 55/481
3,391,682 A 7/1968 King et al.
3,830,146 A * 8/1974 Kaiser ..... 454/255
3,851,639 A 12/1974 Beddoe
3,880,139 A * 4/1975 Young ..... 126/9 R
3,915,144 A * 10/1975 Tomita ..... 126/9 R
3,915,145 A 10/1975 Tomita
4,183,348 A * 1/1980 Smith ..... 126/545
4,216,760 A * 8/1980 Wiggins ..... 126/508
4,245,614 A * 1/1981 Hurwitz et al. ..... 126/502

(Continued)

*Primary Examiner*—Kenneth B Rinehart
*Assistant Examiner*—Jorge Pereiro
(74) *Attorney, Agent, or Firm*—Adorno & Yoss, LLC; R. Stevan Coursey

(57) ABSTRACT

A device for arresting spark and ash issuing from, and precisely controlling the ventilation of and temperature inside, a heat source-containing vessel such as a cooking grill, stove, oven, cooker, fireplace, heater, or firebox. The device comprises a spark arrestor assembly including a base plate, a cover plate, and a spark arrestor. The base plate defines an opening. The cover plate and spark arrestor are slidably mated in two channels formed in the base plate around the opening. The cover plate and spark arrestor may be adjusted to extend across or only partway across the opening as selected by a user of the device. Tabs are provided on the cover plate and spark arrestor for easy adjustment thereof. Tabs in the base plate are positioned to define a range of slidable motion of the cover plate and spark arrestor. The spark arrestor assembly engages a fire-containing or heat source-containing vessel over an opening defined by the vessel so that the vessel opening cooperates with the spark arrestor assembly opening.

17 Claims, 5 Drawing Sheets

U.S. PATENT DOCUMENTS 4,489,706 A * 12/1984 Hait ..... 126/9 R
4,508,094 A * 4/1985 Hait ..... 126/9 R
4,587,947 A * 5/1986 Tomita ..... 126/25 R
4,760,773 A * 8/1988 Pezzulli ..... 454/358
D318,327 S * 7/1991 Sorensen ..... D23/348
5,251,607 A 10/1993 Traeger et al.
5,740,849 A * 4/1998 Tashman ..... 160/102
2004/0079357 A1 * 4/2004 Klemming ..... 126/519

* cited by examiner

SPARK ARRESTOR AND AIRFLOW CONTROL ASSEMBLY FOR A PORTABLE COOKING OR HEATING DEVICE

This application claims priority from co-pending Provisional Patent Application Ser. No. 60/705,912, filed Aug. 5, 2005, and entitled Spark Screen.

FIELD OF THE INVENTION

The present invention relates to spark and ash arrestors and ventilation devices for heat source-containing vessels, such as cooking grills, stoves, ovens, cookers, fireplaces, heaters, and fireboxes.

BACKGROUND OF THE INVENTION

Many prior art devices are known for arresting sparks and ash and for providing ventilation in fire-containing vessels such as cooking grills and fireplaces. For example, in U.S. Pat. No. 1,537,216, a protective screen is disclosed for preventing fire from falling out of a door of a stove. The protective screen is arranged in a door opening of the stove and supported by fastening elements secured to a frame surrounding the door opening. The screen can be made of any desired mesh for the purpose intended. In one embodiment, the screen is mounted to a pivotable frame attached to the stove by hinges wherein the frame can be secured in a closed position with a rotatable latch.

In U.S. Pat. No. 1,641,022, a spark arrester is provided in the nature of a damper and regulator for fire places to retard the escape of heat up a chimney and, when closed, to prevent the ingress of insects. The spark arrester includes an elongated curved body plate with a plurality of spaced parallel slots, with the body plate being positioned to follow the curvature of the back of a brick fireplace. A second plate with a plurality of spaced parallel slots is mounted to the inner face of the body plate and is capable of slidable movement with respect to the body plate such that in an open position the slots of the body plate cooperate with the slots of the second plate and in a closed position the slots of the body plate align with the second plate.

In U.S. Pat. No. 2,722,883, a single slidable draft door is provided for controlling the degree of heat reaching a grid iron of a charcoal broiler by controlling the amount of air passing through a draft opening. The draft door is held in place and supported by slides and stops mounted to the charcoal broiler.

In U.S. Pat. No. 3,391,682, a single slide with a series of slots is slidably mounted to a slotted air vent of a charcoal broiler. The slide can be slid to cover the slots of the air vent to block the flow of air into the broiler or slid so that the slots of the slide and the slots of the air vent allow air passage through the charcoal broiler.

U.S. Pat. No. 3,851,639 discloses sliding doors provided for a portable cooking apparatus. A first single door is slide-mounted to the cooking apparatus so that it can independently be moved in one direction to completely open a related slot, moved in an opposite direction to completely close the related slot, or moved to an intermediate position. An operating tab is provided to move the door. By moving the door, burning of paper fuel in the cooking apparatus can be controlled. A second single door is provided on an oven sidewall of the cooking apparatus. The second door is mounted inside the sidewall in upper and lower slide ways and can be moved to leave an opening completely open, completely closed, or partially open to obtain intermediate temperatures in the cooking apparatus.

U.S. Pat. No. 3,915,145 discloses a single sliding door for access to a chamber of a cooking stove. The sliding door is mounted within a door slide channel. A portion of the channel is removed to provide an ash fall-off area. The door can be slid to reveal an opening for insertion of combustible materials and for provision of a bottom draft. A handle is provided on the sliding door. The door is closed after ignition of paper fuel in the stove to prevent fine newspaper ash from flying in an air draft created by rising heat. Also disclosed is a single upper vent slide gate having a handle. The upper vent slide gate closes an upper vent opening by sliding between two parallel spot-welded channels. The upper vent slide gate can be opened or closed to control air entry and regulate heat intensity inside the stove.

U.S. Pat. No. 4,587,947 discloses a sliding plate that selectively closes a central rectangular opening in a leg assembly plate of a portable grill apparatus.

In U.S. Pat. No. 5,251,607, a spark arrester is provided on the rear of a pellet-fired cooking grill. The spark arrester is perforated or slotted and mounted through a hinge on a base of a lip on the cooking grill. The spark arrester is slotted to permit air flow to support combustion.

None of the foregoing devices are completely satisfactory for arresting sparks and ash issuing from a heat source-containing vessel and none of the foregoing devices are completely satisfactory for precisely controlling ventilation and air flow to and from a heat source-containing vessel. None of the foregoing devices discloses a structure with a dual cover plate and spark arrestor both slidably movable with respect to one another.

SUMMARY OF THE INVENTION

The present invention provides a device for arresting sparks produced in a heat source-containing vessel such as a cooking grill, stove, oven, cooker, fireplace, heater, or firebox. The device comprises a spark arrestor assembly including a base plate, a cover plate, and a spark arrestor. The base plate defines an opening. The cover plate and spark arrestor are slidably mated in two channels formed in the base plate around the opening. The cover plate and spark arrestor may be adjusted to extend across or only partway across the opening as selected by a user of the device. Tabs are provided on the cover plate and spark arrestor for easy adjustment. Protruding tabs in the base plate are positioned to define a range of slidable motion of the cover plate and spark arrestor. The spark arrestor assembly engages a fire-containing or heat source-containing vessel over an opening defined by the vessel so that the vessel opening cooperates with the spark arrestor assembly opening.

The cover plate and spark arrestor can be operably slid by the tabs to facilitate the control of airflow to and from a source of heat within the vessel and to arrest sparks and ash issuing from the source of heat. The cover plate and spark arrestor are both slidably movable with respect to one another and each can be slid substantially independently of the other along the channels in a variety of overlapping configurations ranging from (i) both the cover plate and spark arrestor covering the vessel opening completely to (ii) neither the cover plate nor the spark arrestor covering the vessel opening at all.

By moving the cover plate and spark arrestor in the above-described manner to leave the opening uncovered, the user can gain access to the inside of the vessel in order, for example: to add fuel, such as charcoal, wood, paper, pellets, or other combustible or smoke-producing materials; to ignite fuel inside the vessel; and to clear ash and burnt materials from the vessel. By moving the cover plate and spark arrestor to some intermediate overlapping configuration, the user can simultaneously control the flow of air to the source of heat inside the vessel and prevent or hinder sparks and ash from issuing from the vessel through the opening. By controlling the flow of air to the source of heat inside the vessel, the user can more precisely control the temperature inside the vessel. By moving the cover plate and spark arrestor to leave the opening completely covered, the user can prevent or substantially hinder both the flow of air to the source of heat inside the vessel and the issuance of sparks, ash, heat, smoke, and flame from the vessel. In the latter configuration, the user can thereby extinguish a flame or other source of heat inside the vessel.

Thus, in one preferred embodiment of the invention a spark arrestor assembly for a portable cooking unit is provided that includes a base plate that is located in surrounding relation to an opening formed in a portion of the portable cooking unit so as to define an access port to the opening and thereby facilitate communication with an interior portion of the portable cooking unit. A spark arrestor is slidingly fastened to a front surface of the base plate so as to be capable of movement between (i) a first position fully covering the access port and (ii) a second position wherein the access port is open. A cover plate is slidingly fastened to a front surface of the base plate and located over top of the spark arrestor so as to be capable of independent sliding movement relative to the spark arrestor and between (i) a first position fully covering the spark arrestor and (ii) a second position wherein the spark arrestor is substantially uncovered.

BRIEF DESCRIPTION OF THE DRAWINGS

These and other features and advantages of the present invention will be more fully disclosed in, or rendered obvious by, the following detailed description of the preferred embodiments of the invention which are to be considered together with the accompanying drawings wherein like numbers refer to like parts and further wherein.

DETAILED DESCRIPTION OF THE PREFERRED EMBODIMENTS

Figure 1:
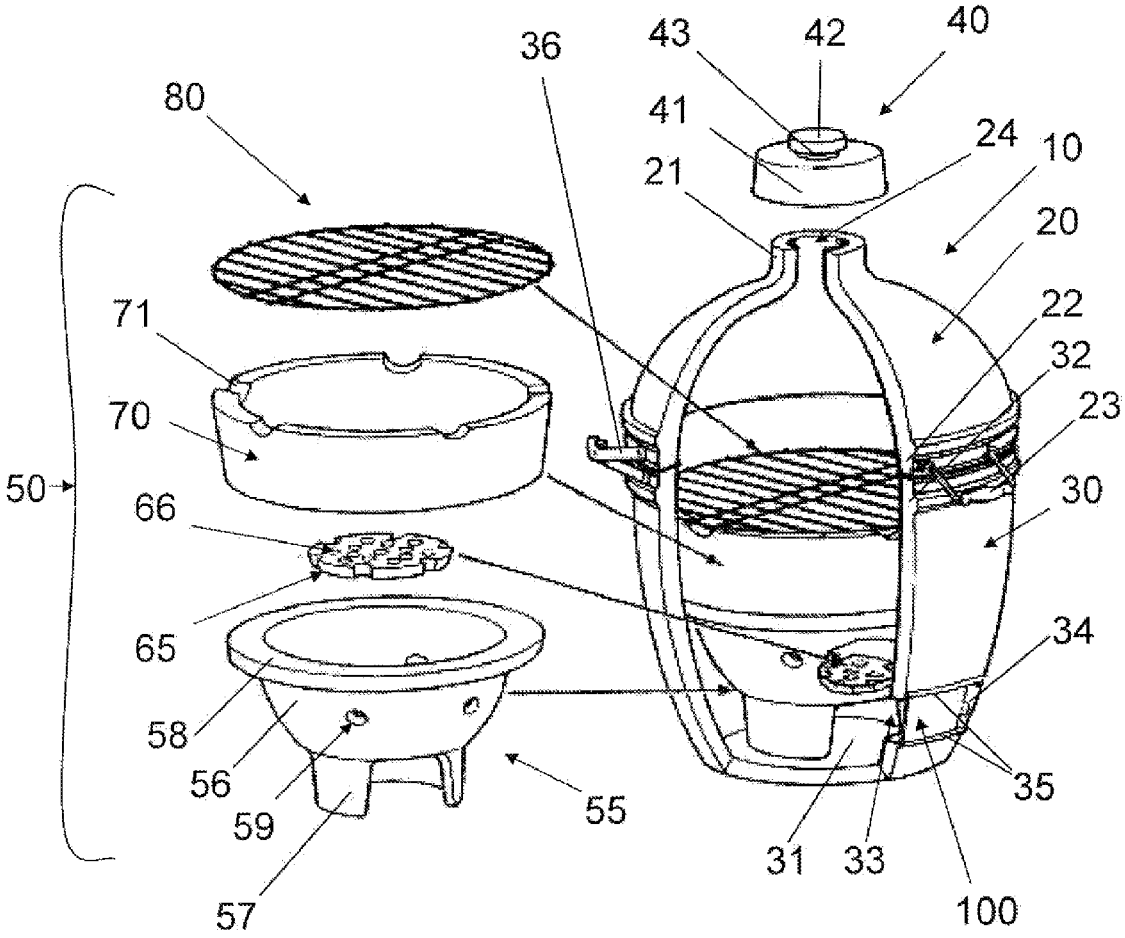
FIG. 1 is an exploded and cut-away perspective view of a portable cooking unit including a spark arrestor assembly formed in accordance with an embodiment of the invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling, or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Referring to FIG. 1, a preferred embodiment of the invention includes a portable cooking unit 10. Portable cooking unit 10 includes a lid 20, a base 30, a damper top 40, a heat source assembly 50, and a spark arrestor assembly 100.

Lid 20 includes a chimney 21, a bottom edge 22, and a handle 23. Lid 20 is substantially domical or paraboloidal in shape. A transverse cross-section of a portion of lid 20 forms an annulus defined by an inner diameter and an outer diameter. The inner and outer diameters are not necessarily constant over a series of such cross-sections. A series of inner diameters of all possible cross-sections spatially defines an interior of lid 20. The cross-section including the minimum value in the series of all possible inner diameters defines a top of lid 20. Chimney 21 protrudes outwardly from the top of lid 20 and defines a cylindrical opening 24. A transverse cross-section of a portion of chimney 21 forms an annulus defined by an inner diameter and an outer diameter. Opening 24 communicates with the interior of lid 20. In a preferred embodiment, opening 24 is defined by a substantially circular edge. Lid 20 has a bottom edge 22 that is substantially circular. Handle 23 is attached to lid 20 and, in at least one embodiment, is provided near bottom edge 22.

Lid 20 may be made of any material suitable for heat source-containing vessels such as, for example, a variety of metal and/or ceramic materials. In a preferred embodiment, lid 20 is made of high quality, heat holding ceramics with thermal insulation properties and capable of enduring extreme temperatures. In another preferred embodiment, lid 20 is coated with a permanent non-toxic porcelain glaze capable of bonding to ceramic material.

Base 30 is substantially an inverted domical or paraboloidal structure including a flat bottom 31 and an annular upper edge 32. Flat bottom 31 is substantially solid and defines an interior face and an exterior face. A transverse cross-section of a portion of base 30 forms an annulus defined by an inner diameter and an outer diameter. The inner and outer diameters are not necessarily constant over a series of such cross-sections. Base 30 has a flat bottom 31 and an annular sidewall that together define an interior chamber. Base 30 defines an opening 33. In a preferred embodiment, opening 33 is substantially rectangular in shape and is defined by two substantially parallel and spaced apart transverse edges 34 and two substantially parallel and spaced apart longitudinal edges 35. In another embodiment, upper edge 32 of base 30 can include a tongue or groove for mating with a complementary groove or tongue provided on a bottom edge 22 of lid 20. Lid 20 and base 30 are pivotally connected via a hinge 34. When bottom edge 22 and upper edge 32 are mated and lid 20 is supported by base 30, the shape of portable cooking unit 10 is substantially an ovoid or oblate ellipsoid that resembles an egg.

Base 30 may be made of any material suitable for heat source-containing vessels such as, for example, a variety of metal and/or ceramic materials. In a preferred embodiment, base 30 is made of high quality, heat holding ceramics with thermal insulation properties and capable of enduring extreme temperatures. In another preferred embodiment, base 30 may be coated with a permanent non-toxic porcelain glaze capable of bonding to ceramic material.

Damper top 40 has a body portion 41 and a cap portion 42. Body portion 41 is substantially cylindrical with one open end and one closed end. A transverse cross-section of a portion of body portion 41 forms an annulus defined by an inner diameter and an outer diameter. The inner and outer diameters are not necessarily constant over a series of cross-sections. The closed end of body portion 41 defines a vent opening 43. Cap portion 42 is attached to body portion 41 such that cap portion 42 can be placed over vent opening 43, completely or partially covering opening 43. In at least one embodiment, cap portion 42 is a slider pivotally attached to body portion 41 with cap portion 42 being perforated and rotatably attached to a perforated daisy wheel such that the daisy wheel can be rotated and the perforations of the daisy wheel and cap portion 42 can be made to cooperate or to be partially or completely covered. Damper top 40 is releasably connectable with chimney 21 and aligns with opening 24. In a preferred embodiment, the open end of damper top 40 is substantially circular with an inner diameter slightly larger than the outer diameter of chimney 21 such that damper top 40 can be easily mated with and easily released from chimney 21. When connected to chimney 21, damper top 40 is used to regulate the upward flow of heated air, and/or smoke through opening 24 of chimney 21. In a closed position, damper top 40 can completely or substantially prevent the flow of heated air, and/or smoke outwardly from the interior of lid 20. Damper top 40 may be made of any material suitable for heat source-containing vessels.

Heat source assembly 50 includes a fire box 55, a grate 65, a fire ring 70, and a cooking grid 80. When assembled, heat source assembly fits inside base 30 and is covered by lid 20. Fire box 55 includes a bowl 56, a support 57, and a flange 58. Support 57 is substantially cylindrical and protrudes from the bottom of bowl 56. Flange 58 projects radially outwardly from an outer annular edge of bowl 56. A transverse cross-section of a portion of flange 58 forms an annulus defined by an inner diameter and an outer diameter. The inner and outer diameters are substantially constant over a series of cross-sections. Bowl 56 defines at least one opening 59 to allow for the flow of air into and out of fire box 55. Fire box 55 may be made of any material suitable for heat source-containing vessels.

Grate 65 is substantially disc-shaped and defines a plurality of perforations 66. Grate 65 provides a durable surface for igniting and burning heating fuel such as, for example, a variety of charcoals, woods, papers, etc. Perforations 66 allow air to flow through grate 65 in order to support the combustion of heating fuel. Grate 65 may be made of any material suitable for heat source-containing vessels.

Fire ring 70 is substantially an upright open-ended cylindrical shell, the transverse cross-section of a portion of which forms an annulus defined by an inner diameter and an outer diameter. The inner and outer diameters do not vary substantially over a series of cross-sections. The outer diameters of fire ring 70 are substantially equivalent to the outer diameters of flange 58. An upper edge of fire ring 70 defines a plurality of scalloped recesses 71. Fire ring 70 may be made of any material suitable for heat source-containing vessels Cooking grid 80 is a substantially circular grate or grill with an outer diameter greater than the inner diameter of fire ring 70. Cooking grid 80 may be made of any material suitable for heat source-containing vessels. In a preferred embodiment, cooking grid 80 is coated with porcelain or other ceramic material.

Figure 2:
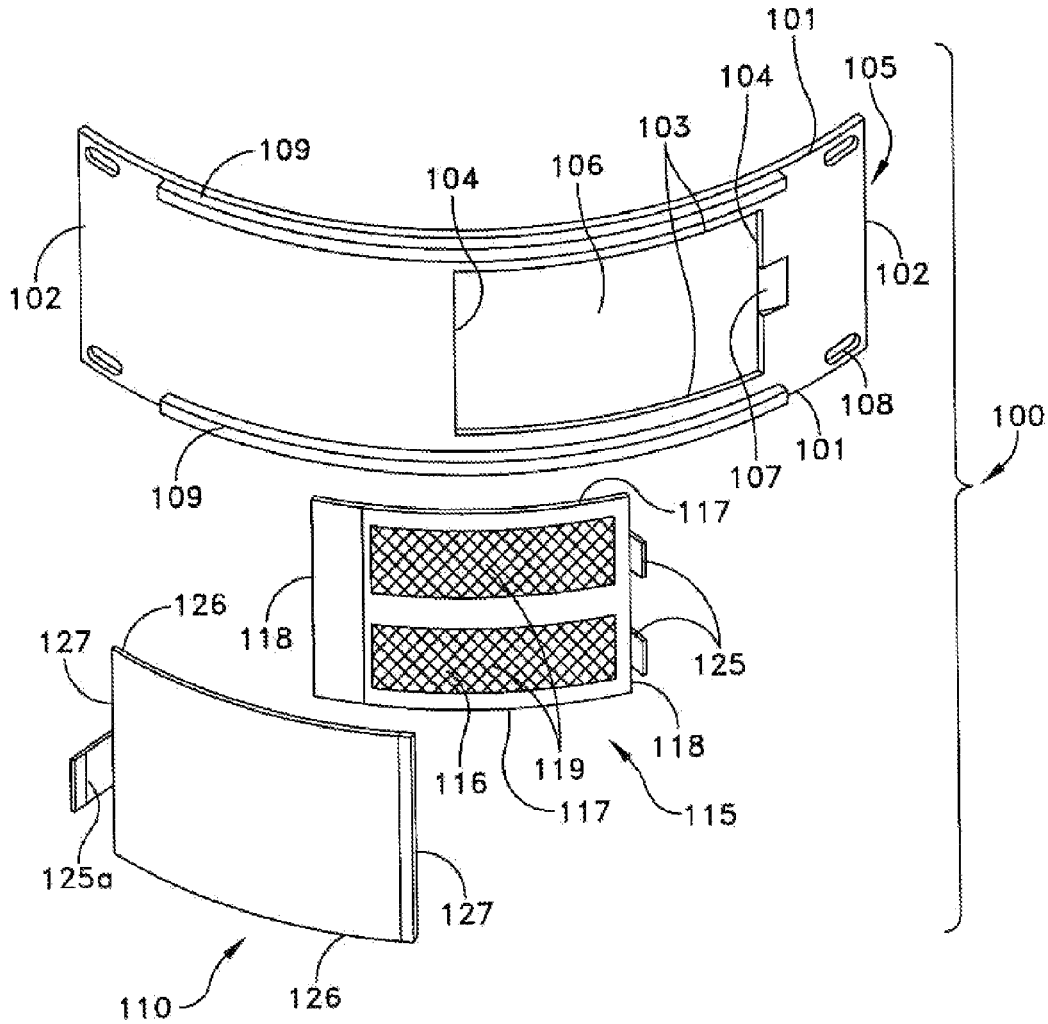
FIG. 2 is an exploded perspective view of a spark arrestor assembly formed in accordance with an embodiment of the invention.

Referring to FIG. 2, spark arrestor assembly 100 includes a base plate 105, a cover plate 110, and a spark arrestor 115. Base plate 105 is substantially rectangular, having two substantially parallel and spaced apart longitudinal sides 101 and two substantially parallel and spaced apart transverse sides 102. Base plate 105 may be bent, contoured, or flat as necessary so as to conform to a vessel. In a preferred embodiment, base plate 105 is bowed, forming an arc so as to engage base 30 over opening 33. Base plate 105 may be attached or mounted within or overlapping edges 34 and 35. Provided along a substantial portion of the longitudinal sides 101 of base plate 105 are two elongated channels 109. Base plate 105 defines an opening 106 that is substantially rectangular and is defined by two substantially parallel and spaced apart longitudinal edges 103 and two substantially parallel and spaced apart transverse edges 104. At least one tab 107 is provided along one of the transverse edges 104 defining opening 106. Tab 107 protrudes outwardly from base plate 105 in the direction of the side of base plate 105 with channels 109. Base plate 105 also defines a plurality of apertures 108 to facilitate the fastening of base plate 105 to base 30. Base plate 105 can be fastened to base 30 with any number of known fasteners, e.g., screws, bolts, rivets, etc. In this way, base plate 105 is located in surrounding relation to opening 33 in base 30 thereby defining an access port to opening 33 and allowing for communication between the ambient environment and the interior portion of portable cooking unit 10.

Spark arrestor 115 is often substantially rectangular in shape, having two substantially parallel and spaced apart longitudinal sides 117 and two substantially parallel and spaced apart transverse sides 118. The transverse sides 118 of spark arrestor 115 are shorter than the transverse sides 102 of base plate 105. The longitudinal sides 117 of spark arrestor 115 are shorter than the longitudinal sides 101 of base plate 105. Spark arrestor 115 can be bent or flat to conform to the shape of a vessel to which spark arrestor assembly 100 is mounted. In a preferred embodiment, spark arrestor 115 is bowed, forming an arc so as to conform to base 30. Along at least one transverse side 118 of spark arrestor 115 is provided at least one tab 125. Tab 125 protrudes outwardly from spark arrestor 115. In a preferred embodiment, two tabs 125 are provided on a transverse side 118 of spark arrestor 115. Spark arrestor 115 defines at least one opening 116. In a preferred embodiment, spark arrestor 115 defines two openings 116, each being substantially rectangular in shape and each being defined by two substantially parallel and spaced apart longitudinal edges and two substantially parallel and spaced apart transverse edges. In a preferred embodiment, a screen 119 is disposed within or overlapping the edges defining openings 116 in spark arrestor 115. Screen 119 may comprise an air permeable mesh or scrim, may be woven or non-woven, and may be formed other materials that are suitable for allowing the flow of air and for preventing the movement of sparks and ash through opening 116.

Cover plate 110 is substantially rectangular, having two substantially parallel and spaced apart longitudinal sides 126 and two substantially parallel and spaced apart transverse sides 127. Transverse sides 127 of cover plate 110 are shorter than transverse sides 102 of base plate 105. Longitudinal sides 126 of cover plate 110 are shorter than the longitudinal sides 101 of base plate 105. Cover plate 110 may be bent or flat to conform to the shape of base 30 to which spark arrestor assembly 100 is mounted. In a preferred embodiment, cover plate 110 is bowed, forming an arc so as to conform to a substantially rounded base 30. Along at least one transverse side of cover plate 110 is provided at least one tab 125*a*. Tab 125*a* protrudes outwardly from cover plate 110.

Spark arrestor assembly 100 is assembled and operated in the following manner. Cover plate 110 and spark arrestor 115 are slidably mated in channels 109 formed in base plate 105 around the opening 106. Both cover plate 110 and spark arrestor 115 slide independently of one another in channels 109, along the longitudinal direction of base plate 105. Advantageously, the independent slidability of cover plate 110 and spark arrestor 115 with respect to one another provides for a continuous range of airflow controlling arrangements. More particularly, cover plate 110 is slidably disposed on an outside surface of spark arrestor 115 such that spark arrestor 115 is located between cover plate 110 and base plate 105. Each of cover plate 110 and spark arrestor 115 may be slidingly adjusted relative to one another, and relative to opening 106, so that one or both may extend fully or only partway across opening 106 as selected by the user to control air flowing toward and through of fire box 55 thereby to precisely control cooking or smoking temperatures within portable cooking unit 10. Cover plate 110 and spark arrestor 115 are easy adjustable by movement of tabs 125 and 125*a*. Tab 107 projecting outwardly from the surface of base plate 105 is positioned so as to define a limit to the continuous range of slidable motion for cover plate 110 and spark arrestor 115. In one preferred embodiment, tab 107 engages cover plate 110 and spark arrestor 115 when either cover plate 110 or spark arrestor 115 individually, or cover plate 110 and spark arrestor 115 together are fully slid and extended across opening 106.

Figure 3:
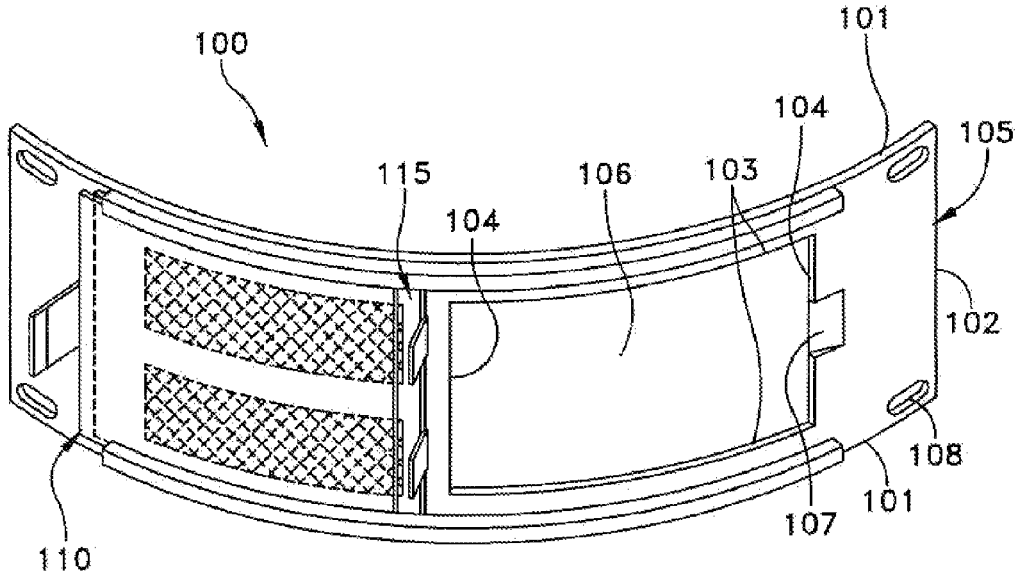
FIG. 3 is a perspective view of a spark arrestor assembly formed in accordance with an embodiment of the invention having its spark arrestor plate and cover plate fully withdrawn from an access port.
Figure 4:
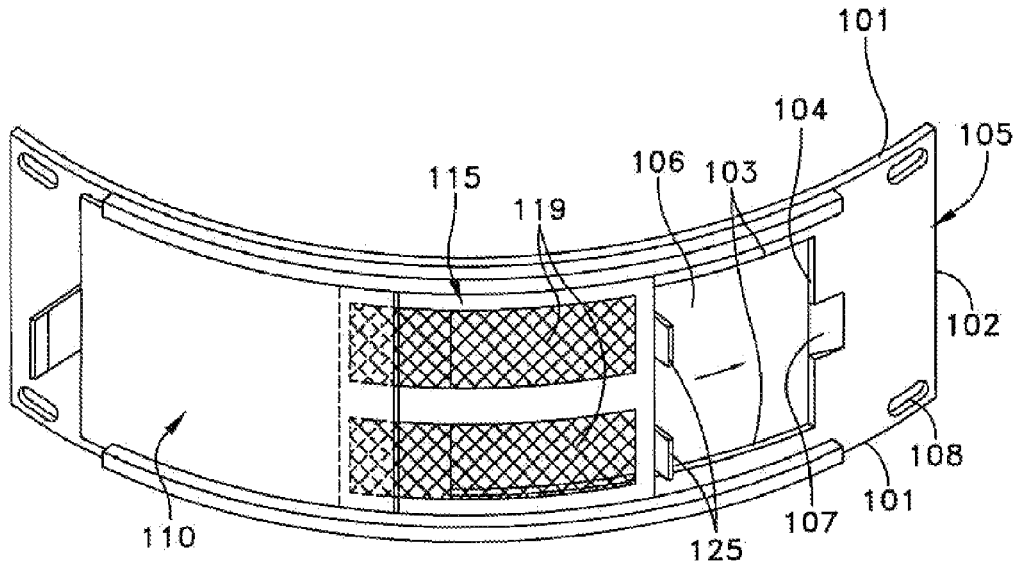
FIG. 4 is a perspective view of a spark arrestor assembly formed in accordance with an embodiment of the invention having its spark arrestor plate partially obstructing an access port but with a cover plate fully withdrawn from the access port.
Figure 5:
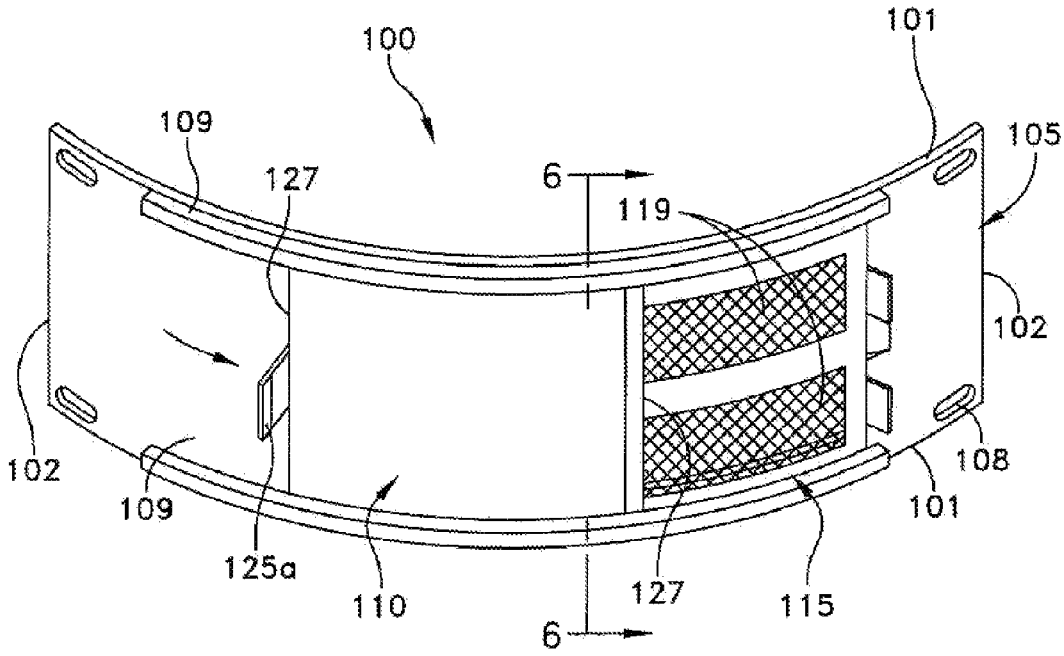
FIG. 5 is a perspective view of a spark arrestor assembly formed in accordance with an embodiment of the invention having its spark arrestor plate obstructing an access port and with a cover plate partially withdrawn from overlying relation with the sparkarrestor and the access port.
Figure 6:
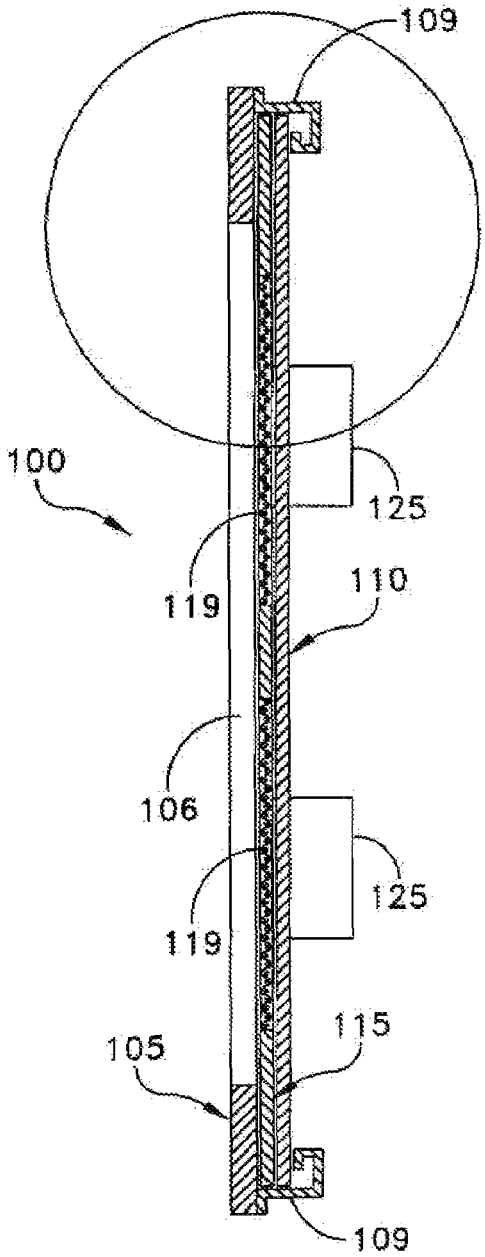
FIG. 6 is a cross-sectional view of the spark arrestor shown in FIGS. 3,4, and 5.
Figure 7:
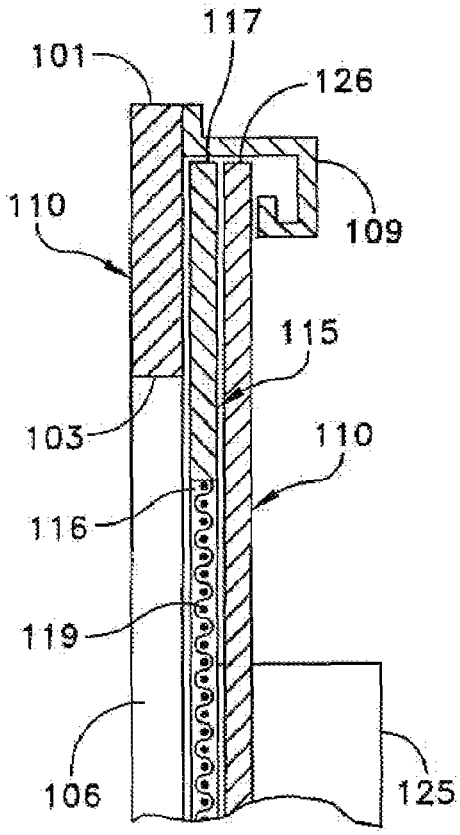
FIG. 7 is an enlarged view of the cross-sectional view of the spark arrestor shown in FIG. 6.

Thus, the range of slidable motion of cover plate 110 includes a fully open position wherein tab 125*a* is a maximum distance from tab 107, and opening 106 is only covered by spark arrestor 115 (FIGS. 3-6). In this arrangement, maximum airflow is allowed through openings 116 and into portable cooking unit 10. Advantageously, screen or mesh 119 located with openings 116 prevents ash and sparks from exiting opening 116. When tab 125*a* is a minimum distance from tab 107, openings 106 and 116 are fully covered by cover plate 110 thereby allowing for a minimum airflow through portable cooking unit 10. When spark arrestor 115 is in a fully open position along with cover plate 110 (FIG. 3) the user's access to and through opening 106 is unimpeded, and ash and other debris may be gathered and removed from flat bottom 31 of base 30. When spark arrestor assembly 100 is in a fully closed position, cover plate 110 completely covers and fully eclipses opening 116 and opening 106. In this closed position, access to opening 106 by the user is completely foreclosed. The range of slidable motion of cover plate 110 and spark arrestor 115 further comprises a continuum of intermediate positions wherein spark arrestor 115 fully or partially overlaps opening 106 and cover plate 110 fully or partially overlaps opening 116 and opening 106 (FIGS. 3-5). In these positions, air is allowed to circulate through portable cooking unit 10 at varying rates relative to the fully open position, but ash and sparks are substantially retained within base 30 by screen or mesh 119 located within openings 116 in spark arrestor 115.

Portable cooking unit 10 is assembled in the following manner. Spark arrestor assembly 100 engages base 30 over opening 33 so that opening 106 is centered over opening 33. In at least one embodiment, spark arrestor assembly 100 is fastened to base 30 over opening 33 with any number of known fasteners inserted through apertures 108. Base 30 is positioned with an exterior face of flat bottom 31 making contact with and being supported by a floor or other supporting structure. Alternatively, base 30 is placed in a supporting structure making contact with a portion of base 30 other than flat bottom 31. Fire box 55 is placed within the interior of base 30 with support 57 making contact with and being supported by an interior face of flat bottom 31. Grate 65 is placed inside fire box 55 and makes contact with and is supported by bowl 56. Fire ring 70 is positioned such that a bottom edge of fire ring 70 that does not include scalloped recesses 71 makes contact with and is supported by flange 58 of fire box 55. Cooking grid 80 is placed on fire ring 70 such that cooking grid 80 makes contact with and is supported by an upper edge of fire ring 70, which upper edge comprises scalloped recesses 71. Lid 20 is pivotally attached to base 30 via hinge 36. Body portion 41 of damper top 40 is mated to chimney 21 of lid 20 such that damper top 40 makes contact with and is supported by lid 20.

Portable cooking unit 10 is operated in the following manner. Fuel including, for example, any variety of charcoals, woods, papers, etc. is placed on grate 65 in fire box 55. The fuel is ignited and sustains combustion. Smoke, heat, and flame rise upwardly from the combusting fuel toward cooking grid 80. Meats and other food are placed on cooking grid 80 to be cooked and/or smoked by rising heated air and smoke. Damper top 40 and spark arrestor assembly 100 are operated independently or coordinately to precisely control the flow of air to the combusting fuel and the upward draft of heated air and smoke away from the combusting heating fuel. By controlling the flow of air and smoke, the temperature inside portable cooking unit 10 can be precisely controlled.

It is to be understood that the present invention is by no means limited only to the particular constructions herein disclosed and shown in the drawings, but also comprises any modifications or equivalents within the scope of the claims.

What is claimed is:

1. A spark arrestor assembly for a portable cooking unit, comprising:

a base plate mountable to and operable with a portable cooking unit in surrounding relation to an opening formed in a portion of the portable cooking unit, said base plate defining an access port to the opening enabling communication with an interior portion of the portable cooking unit, said base plate having opposed transverse sides and being bowed between said opposed transverse sides to correspond to the curvature of a portion of a base of the portable cooking unit having a shape comprising part of a body of revolution and to which a back surface of said base plate is adjacently mountable in contact with the portion of the base;

a spark arrestor slidingly fastened to a front surface of said base plate and slidingly movable along a non-linear path between (i) a first position fully covering said access port and (ii) a second position wherein said access port is open, said spark arrestor having opposed transverse sides and a tab protruding proximate one of said transverse sides for use in slidingly moving said spark arrestor relative to said access port; said spark arrestor having opposed longitudinal sides and defining a plurality of holes located between said longitudinal sides, said spark arrestor having a portion extending between said holes; and a cover plate slidingly fastened to a front surface of said base plate and substantially adjacent said spark arrestor, said cover plate being slidingly movable along a non-linear path independent of and relative to said spark arrestor and between (i) a first position fully covering said spark arrestor and (ii) a second position wherein said spark arrestor is substantially uncovered, and said cover plate having opposed transverse sides;

wherein one of said transverse sides of said cover plate is engageable by said tab of said spark arrestor for causing sliding movement of said spark arrestor and said cover plate in tandem when said spark arrestor is moved in a sliding manner relative to said access port:

wherein each of said spark arrestor and said cover plate have respective opposed transverse sides and are bowed between said respective opposed transverse sides to correspond to the curvature of the portion of the base of the portable cooking unit having a shape comprising part of a body of revolution.

2. The spark arrestor assembly of claim 1 wherein said spark arrestor and said cover plate are continuously movable substantially independently of one another so as to define a plurality of airflow openings communicating with an interior portion of the portable cooking unit.

3. The spark arrestor assembly of claim 1 wherein said base plate defines at least one access port opening and comprises a plurality of longitudinally arranged and spaced apart channels into which edge portions of said cover plate and said spark arrestor are slidingly received.

4. The spark arrestor assembly of claim 3 wherein said spark arrestor is movable over a range of motion comprising a continuum of positions wherein said spark arrestor at least one of fully overlaps and partially overlaps said access port.

5. The spark arrestor assembly of claim 3 wherein said cover plate is movable over a range of motion comprising a continuum of positions wherein said cover plate at least one of fully overlaps and partially overlaps said access port.

6. The spark arrestor assembly of claim 1 wherein said holes are arranged in airflow communication between said access port and the interior portion of the portable cooking unit.

7. The spark arrestor assembly of claim 1 wherein said cover plate and said spark arrestor are adjustable to extend at least one of fully across and partially across said access port.

8. The spark arrestor assembly of claim 1 wherein said holes of said spark arrestor are obstructed by at least one of a screen and a mesh so as to prevent ash and sparks from exiting said access port while allowing for airflow communication through said access port to the interior portion of the portable cooking unit.

9. A spark arrestor assembly for a portable cooking unit, comprising:

a base plate having a plurality of longitudinally arranged, spaced-apart channels and defining at least one opening between said channels, said base plate being attachable adjacent to and in contact with a wall of a portable cooking unit proximate an opening extending through the wall to an interior portion of the portable cooking unit, the wall having a shape corresponding to a portion of a substantially paraboloidal body of revolution;

a spark arrestor defining a plurality of holes obstructed by screen so as to prevent ash and sparks from exiting said at least one opening of said base plate while allowing for airflow communication through said at least one-opening of said base plate to the interior portion of the portable cooking unit, said spark arrestor having a portion extending between said holes of said plurality of holes; and a cover plate located substantially adjacent said spark arrestor, wherein said spark arrestor and said cover plate are slidably mated to said base plate via said channels, and said spark arrestor is operably slidable within said channels along a non-linear path and said cover plate is operably slidable within said channels along a non-linear path and independently of said spark arrestor, wherein said spark arrestor and said cover plate are selectively slidable independently of one another relative to said channels, wherein said spark arrestor and said cover plate are alternatively selectively slidable in unison relative to said channels via coupling of said spark arrestor and said cover plate; and wherein each of said base plate, said spark arrestor, and said cover plate have respective opposed transverse sides and are bowed between said respective opposed transverse sides to correspond to the shape of the wall.

10. The spark arrestor assembly of claim 9 wherein said spark arrestor is adapted for coupling to said cover plate during sliding movement of said spark arrestor within said channels that causes said opening between said channels to be less occluded by said spark arrestor.

11. The spark arrestor assembly of claim 9 wherein said spark arrestor is positioned at least partially between said cover plate and said base plate.

12. The spark arrestor assembly of claim 9 wherein said cover plate and said spark arrestor are slidably adjustable to extend at least one of fully across and partially across said at least one opening between said channels.

13. The spark arrestor assembly of claim 9 wherein said spark arrestor and said cover plate are adjustable to control a flow of air into the portable cooking unit.

14. A spark arrestor assembly for a portable cooking unit, comprising:

a base plate defining at least one opening and comprising a plurality of longitudinally arranged and spaced apart channels and at least one first tab, said base plate having a back surface mountable adjacent to and in contact with a wall of a portable cooking unit having an interior portion, the wall having a substantially domical shape;

a spark arrestor including at least one second tab and defining two, parallel openings that are each obstructed by an air permeable mesh so as to prevent ash and sparks from exiting said parallel openings while allowing for airflow communication through said parallel openings to the interior portion of the portable cooking unit, said spark arrestor having a portion extending between said parallel openings; and a cover plate having at least one third tab wherein said spark arrestor and said cover plate are arranged one adjacent the other so as to be independently slidably mated to said base plate within said spaced-apart channels, said spark arrestor being operably slidable via said at least one second tab and said cover plate being operably slidable via said at least one third tab so that said spark arrestor and said cover plate are slidable along a non-linear path over a range of positions that are limited by said at least one first tab, and said spark arrestor and said cover plate being further operably slidable along a non-linear path in unison via said at least one second tab over a range of positions limited by said at least one first tab;

wherein each of said base plate, said spark arrestor and said cover plate have respective opposed transverse sides and are bowed between said respective opposed transverse sides to mirror the substantially domical shape of the wall.

15. The spark arrestor assembly of claim 14 wherein said spark arrestor is positioned between said cover plate and said base plate.

16. The spark arrestor assembly of claim 14 wherein said range of positions is continuous wherein said spark arrestor is at least one of fully overlapping and partially overlapping said at least one opening of said base plate and said cover plate is at least one of fully overlapping and partially overlapping at least one of said parallel openings of said spark arrestor.

17. The spark arrestor assembly of claim 14 wherein said base plate defines a plurality of apertures for fastening of said base plate to the wall of the portable cooking unit.

* * * * *